United States Patent [19]

Weil

[11] 4,052,158

[45] Oct. 4, 1977

[54] TEXTILE FINISHING PROCESS

[75] Inventor: Edward D. Weil, Hastings-on-Hudson, N.Y.

[73] Assignee: Stauffer Chemical Company, Westport, Conn.

[21] Appl. No.: 722,854

[22] Filed: Sept. 10, 1976

Related U.S. Application Data

[63] Continuation of Ser. No. 410,643, Nov. 12, 1973, abandoned.

[51] Int. Cl.[2] ..... D06M 1/00

[52] U.S. Cl. ..... 8/116 P; 8/115.6; 8/120; 8/128 A; 8/128 R; 8/184

[58] Field of Search ..... 8/116 P, 184

[56] References Cited

U.S. PATENT DOCUMENTS

| | | | |
|---|---|---|---|
| 3,434,161 | 3/1969 | Walsh | 2/243 |
| 3,558,263 | 1/1971 | Baitinger | 8/116.3 |
| 3,561,916 | 2/1971 | Baitinger | 8/116.3 |
| 3,703,351 | 11/1972 | Lock | 8/116.3 |
| 3,708,261 | 1/1973 | Kasper et al. | 8/116.3 |
| 3,755,323 | 8/1973 | Weil et al. | 260/249.6 |

FOREIGN PATENT DOCUMENTS

| | | |
|---|---|---|
| 1,495,383 | 8/1973 | Germany |
| 779,231 | 7/1957 | United Kingdom |

OTHER PUBLICATIONS

Sumrell et al., Textile Research Journal, Jan. 1969, pp. 78–85.

Mark et al., "Chemical Aftertreatment of Textiles" (Wiley–Interscience) 1971, pp. 259–261.

*Primary Examiner*—Joseph L. Schofer
*Assistant Examiner*—A. L. Clingman
*Attorney, Agent, or Firm*—William R. Robinson

[57] ABSTRACT

A process for producinga wash-durable finish on a textile is provided which comprises applying to the textile an effective amount of:

a. at least one free-radical polymerizable monomer having a functional group capable of undergoing an acid catalyzed condensation reaction with b. at least one co-reactant having a reactive methylol, hydroxy, alkoxy or amino group capable of undergoing acid-catalyzed condensation with a reactive group on said free radical polymerizable monomer;

c. at least one free radical generating catalyst and at least one acid catalyst, or at least one catalyst having both free radical generating and acidic characteristics, and d. subjecting said textile to curing conditions to conjointly effect free radical polymerization and acid-catalyzed condensation reactions.

11 Claims, No Drawings

TEXTILE FINISHING PROCESS

This is a continuation, of application Ser. No. 410,643 filed Nov. 12, 1973 now abandoned.

This invention relates to a textile finishing process. More particularly, this invention relates to an in situ process for imparting a durable finish to textiles by effecting on a textile, free radical polymerization and condensation via aminoplast functionality to impart durable properties such as flame retardancy, soil resistance, grease resistance, water resistance, and the like to the textiles.

The concurrence of a tremendous surge in textile safety regulatory activity and consumer demands for versatility of textile applictions has presented the textile industry with a severe test of the adequacy of its current textile finishing technology. Although textile treatments have been developed which are suitable for imparting fire retardance, soil resistance, water resistance, and the like to textiles, these treatments have been generally considered inadequate because of their lack of durability. As regulatory activity and the stringency of standards increases, there arises the need for processes for imparting a variety of durable finishes to textiles. Even the current mandatory fire safety regulations which confront the textile industry present a clear and present need for such processes.

Various performed polymers such as polyacrylates, polyvinyl chloride and the like have heretofore been employed in textile finishing processes to impart the above-described properties to textiles. One problem which has been common to such finishing processes is that these polymers tend not to penetrate into fibers, such as cotton, rayon and the like, and thus coat the fibers only superficially. Under these circumstances, the polymer is subject to removal by laundering and/or abrasion during normal use of the textile. Also, when the polymer is a fairly stiff one, the "hand" (tactile quality) of the fabric is affected adversely. Moreover, the polymer, being on the outer surface of the fibers, tends to cause fiber-to-fiber attachments which prevent the normally free motion of the fibers thereby further affecting the hand and sometimes the strength of the fabric.

Various processes have previously been employed for preparing polymers in situ in fibers from non-polymer reactants. These are reviewed by Mark, Wooding and Atlas in "Chemical Aftertreatment of Textiles", Wiley-Interscience, New York (1971). These processes fall into two main classes:

1 Free radical in situ polymerization

In these processes, a vinyl monomer such as acrylic acid or its derivatives on and possibly within the fibers is polymerized by a free radical catalyst to a vinyl polymer. Sometimes grafting onto the textile fiber accompanies such polymerization especially if means are employed to generate "graft sites" on the fibers. Such processes have found very little actual usage because of the limited variety of monomers and polymers that could thus be formed in practical textile mill operations. The grafting aspect, although much studied, has found little actual use largely because of the expense and difficulty of inducing sufficient graft sites on the fibers or getting sufficient grafted polymers to form.

2. Aminoplast resin formation

In these processes, -NH and -NCH(OR)- containing compounds such as urea-formaldehyde, urea-glyoxal, or melamineformaldehyde are caused to form resins, usually of a crosslinked type, by means of acid catalysis which brings about formation of -NCH-N-bonds and/or attachment of NCH- groups to the fiber (where the fiber is reactive as in the case of fibers having -OH or -NH groups to form -NCH-N or -NCH-O links).

Generally, the above-described processes having been employed as two separate and distinct processes or operations. For example, it is known to apply N-methylolacrylamide to a cellulosic fabric, to attach it to the cellulose via acid-catalyzed aminoplast resin chemistry, and then, as a separate operation, employ the use of high-energy radiation, to induce free radical polymerization of the double bonds. (See, for example, W. Walsh, U.S. Pat. No. 3,434,161). This process has found no commercial usage to date primarily because of the special radiation apparatus involved.

It is also known to preattach a desired group, as for example, $(CH_3O)_2P(O)CH_2CH_2CONHCH_2OH$ (as in German Patent No. 1495383) or a melamine resin (as in British Patent No. 779,231) to a vinyl monomer group by aminoplast resin (acid catalyzed) chemistry, and such monomers could presumably then be applied in a free radical curing step on the textile, but again, two distinct processes (operations) are involved.

It is also known (Kamogawa et al., Japanese Patent No. 363,142, reported by Mark et al., loc. cit. p. 260) that N-methylolacrylamide can be both polymerized and condensed in cotton. No use, however, was made of this reaction scheme to bind a co-reactant to the fabric to impart a wide variety of finish properties thereto.

The present invention distinguishes itself from the prior art described above in that it employs both free radical and acid catalyzed condensation chemistry conjointly, i.e., a single process step, employing a catalyst or combination of catalyst having both free radical and acid catalysis capabilities, to form novel polymeric textile finishes. In the new textile finishes, the polymeric networks are currently considered to be based on C-C linkages formed by the free radical polymerization as well as linkages formed by acid-catalyzed condensation polymerization between polymer chains and/or between polymer chains and the fiber and/or between polmyer chains and useful side chains. Since the invention employs small molecular weight reactants as contrasted with the polymers of the prior art process outlined in (1) above, good fiber penetration is possible and durable finishes of good hand are obtained. Since the process of the invention requires only one process step, it is economically advantageous over the two-step or multi-step processes of the prior art.

Accordingly, it is an object of the present invention to provide a process for imparting a variety of durable finishes to textiles.

It is another object of the present invention to provide an in situ, one-step textile finishing process wherein by appropriate selection of reactants, wide variety of finishes can be durably imparted to textiles.

These as well as other objects are accomplished by the present invention which provides a process for producing a wash-durable finish on a textile comprising applying to the textile an effective amount of at least one free radical polymerizable monomer having a functional group capable of undergoing an acid-catalyzed condensation reaction with at least one coreactant having reactive methylol, hydroxy, alkoxy or amino groups capable of undergoing acid-catalyzed condensation with a reactive group on said free radical polymerizable monomer; along with a free radical generating catalyst and an acid catalyst or a single catalyst with both free radical and acid catalyst character and subjecting said textile to curing conditions to conjointly effect free radical polymerization and acid-catalyzed condensation reactions.

A solvent, such as water, alcohol, perchloroethylene, methylchloroform, or the like can be employed, if desired, as a carrier for these reactants and catalysts.

Suitable free radical polymerizable monomers with functional groups capable of reaction under acid-catalyzed aminoplast resin-forming conditions with a coreactant having reactable methylol, hydroxy, alkoxy or amino groups include acrylamide, methacrylamide, N-methylolacrylamide, N-methylolmethacrylamide, N-(alkoxymethyl)acrylamide, diacetoneacrylamide, i.e., $CH_2=CHCONHC(CH_3)_2CH_2COCH_3$, the methylolated products of diacetonelacrylamide, and 2-hydroxyethyl acrylate, and 2-hydroxyethyl methacrylate.

The preferred monomer, because of its favorable balance of low cost, low volatility, and high reactivity, is N-methylolacrylamide. Within the class of monomers suitable for use in the process of the invention, two subclasses can be distinguished:

e. those which have suitable functionality to permit them to react under acid-catalyzed conditions with an -OH, -O-alkyl, or -NH group to form C-O or C-N bonds, such functionality being encompassed by the term "reactive methylol compounds", exemplified by compounds having methylol groups or ethers or esters thereof (i.e., by $-N(CH_2OH)-$, $-N(CH_2O\text{-alkoxy})$, $-N(CH_2\text{-O-acyloxy})$ and $C(=O)\ C\text{-}CH_2OH$ groups; and f. those which are not per se reactive methylol compounds, but which contain -OH, -O-alkyl, or -NH groups which can undergo acid-catalyzed condensation reactions with reactive methylol compounds.

Subgroup (e) is exemplified by N-methylolacrylamide, N-methylolmethacrylamide, N-(alkoxymethyl) acrylamide, N-(alkoxymethyl) methacrylamide, and the methylolation products of diacetonelacrylamide; whereas, subgroup (f) is exemplified by acrylamide, methacrylamide diacetonelacrylamide 2-hydroxyethyl acrylate and 2-hydroxyethyl methacrylate.

An effective quantity of the free radical polymerizable monomer will generally range from about 2 to 50%, and more preferably from about 3 to 40% calculated on the weight of the textile fabric.

Reactants capable of co-reaction under acid-catalyzed condensation reaction conditions likewise can be subdivided into two subclasses:

g. those which have reactable -OH, -O-alkyl or -NH groups capable of acid-catalyzed condensation reaction with reactive methylol groups, but which are not per se reactive methylol compounds; and h. those which are per se, reactive methylol compounds and which can react both with reactive methylol groups of the monomer (or its polymer) or which can react with -OH or -NH groups of monomer units not per se having ractive methylol groups.

Class (g) encompasses alcohols, especially primary alcohols, primary and secondary amines and amides having -NH groups, aminoalkyl-substituted polysiloxanes silanols and alkoxysilanes which can hydrolize to silanols.

Class (h) encompasses methylolamides, methylolmelamines, methylolureas, methylolcarbonates, methylolguanidines, methyloldicyandiamides, glyoxalurea adducts and the ethers and esters of these, and quaternary alkylating agents of the type $R''_3N^+CH_2NHCOR'$ (wherein R' and R'' can both be alkyl or $R''_3N$ may represent a pyridinium ring).

An effective quantity of the co-reactant will generally range from about 2 to 50%, and more preferably, from about 3 to 40% calculated on the weight of the textile fabric.

Free radical catalysts which can be employed include oranic and inorganic peroxy compounds and azo compounds, for example, persulfate salts, perphosphate salts, t-butyl hydroperoxide, di-t-butyl peroxide, cumene hydroperoxide, methyl ethyl ketone peroxiide, benzoyl peroxide, t-butyl peroxysuccinate, t-butyl perbenzoate, azobisisobutyronitrile and azobisisovaleronitrile. Preferred catalysts because of their water solubility and their ability to serve also in the role of acidic catalysts are the water soluble persulfate salts, such as ammonium, sodium and potassium persulfate.

Acidic catalysts which can be employed include hydrochloic, sulfuric, fluoboric, acetic, lactic, glycolic citric, tartaric and oxalic acids, acidic salts such as magnesium chloride, ammonium chloride, zinc chloride; magnesium nitrate, fluoborate or fluosilicate; zinc nitrate, fluborate, or fluosilicate; amine hydrochlorides, sodium bisulfate, potassium bisulfate, monoammonium phosphate, and the like.

It is, however, considered most preferable to use a persulfate salt, which supplies the acid catalysis as well as the free radical catalysis required in the process of the invention.

An effective amount of catalyst gennerally ranges from about 0.01 to 10% by weight of the reactants, and preferably ranges from about 0.05 to 5%.

Co-reactants of class (g) above include primary alcohols containing phosphorus, such as the pentavalent phosphorus esters containing primary alcohol roups as disclosed in applicant's copending U.S. application Ser. No. 410,583 filed the same date as this application and now abandoned in favor of CIP application Ser. No. 558,862, filed Mar. 17, 1975, $(HOCH_2)_3PO$, $(HOCH_2)_2P(O)CH_2[OCH_2P(O)(CH_2OH)CH_2]OH$, HO-alkylene-$PO(OR)_2$ and the like, amines such as $NH_2CH_{(3-a)}(CH_3)_a PO(O\text{-alkyl})_2$, phosphorus-containing amides such as $NH_2C(O)CH_2CH_2P(O)(OCH_3)_2$, $(NH\text{-[alkyl or H]}_{1,2}P(O)(O\text{-alkyl})_{2,1}$ $PO(NH_2)_3$, $PO(NH\text{-alkyl})_3$, $[P(O)(CH_3)NHCH_2\ CH_2NH\text{-}]_x$, $[P(O)(CH_3)OCH_2CH_2NH]_x$, sulfonamides such as $NH_2SO_2NH_2$, $NH_2SO_3H$, and $NH_2SO_3NH_4$, and bromine-containing reactants such as $HOCH_2NHCOOCH_2CHBrCH_2Br$ or $HOCH_2C(CH_2Br)_2CH_2OH$. Preferred examples because of commercial availability are $PO(NHCH_3)_3$, $NH_2SO_3NH_4$, and $(HOCH_2CH_2)_2NCH_2P(O)(OC_2H_5)_2$.

The amounts required to impart flame retardant properties are such as to cause from about 0.5 to 5% phosphorus or sulfur to be attached to the fabric.

Co-reactants of class h above include hydroxymethylated or alkoxymethylated triazinylaminoalkyl phosphonates such as those of applicant's U.S. Pat. No. 3,755,323 or of Tesoro, U.S. Pat. No. 3,551,422 (1970), methylolated amide phosphonates such as $HOCH_2NHCOCH_2CH_2P(O)(OCH_3)_2$ or methylolated $NH_2CO\text{-O-alkylene-}PO(O\text{-alkyl})_2$.

Co-reactants of type (g) which can be employed to impart water repellant and softening properties include long chain ($C_6$-$C_{22}$) primary alcohols or amines, such as octyl, dodecyl, hexadecyl, and eicosyl alcohol, long chain amides such as caproamide, or stearamide, fatty acid diethanolamides, monoglycerides, polyfluoroalkyl alcohols, or amines, amides of polyfluorinated fatty acids, polyfluorinated alkylsulfonamides, or silanols or alkoxysilanes which hydrolyze to silanols or aminoalkyl-substituted polysiloxanes.

Co-reactants of type (h) which can be employed to impart water repellant and softening properties include N-methylolated long chain fatty amides; also, N-methylolated long chain alkylureas, etherified methylolmelamines containing at least one long chain quaternary ammoniomethylated long chain fatty amides such as N-(stearamidomethyl)pyridinium salts, quaternary ammoniomethylated long chain alcohols such as N-(octadecyloxymethyl)pyridinium salts, 3,6-dioxatetracosyloxymethylenepyridinium salts, or stearatoethoxymethylpyridinium salts, these quaternary salts being water soluble equivalents of the corresponding methylol compounds.

Anti-soiling properties can be imparted by employing as co-reactants carboxymethyl cellulose, hydroxyethyl cellulose, hydroxyl-terminated poly(alkylene amides), glycolic acid, polyfluoroalkylamines, polyfluoroalkanols, or polyfluoroalkanamides.

Antistatic properties can be imparted by employing co-reactants hydroxy-terminated poly(alkylene oxide), polyoxyethylated alkylphenols, polyoxyethylated glycerides.

Cross-linking which imparts crease resistance or durable press properties can be achieved by using as co-reactants in the process of the invention such reactive methylol compounds as methylolated ureas, cyclic ureas, urons, triazones, melamines, dicyandiamides, and urethanes or ethers or esters thereof. Examples are dimethylolurea, dimethylolethyleneurea, dimethylolpropyleneurea, dimethylolmethyluron, dimethoxymethylethyleneurea, methylolmelamine, dimethoxymethylolmelamine trimethylolmelamine, pentamethylolmelamine, hexamethylolmelamine (or the partially or fully etherified derivatives thereof such as pentamethoxymethylmelamine), dimethylolmethylcarbamate, dimethyl isobutyl carbamate, tris(N-methylol-2-carbamoylethyl) amine, trimethylolglyoxaldiurein, dimethyloldihydroxyethyleneurea, and dimethylodicyandiamide.

When the free radical curable monomer is one having reactive methylol groups, such as N-methylolacrylamide or hydroxymethylated diacetonylacrylamide, the co-reactant can be of the above type, or can be of the type (g) such as an unmethylolated urea, ethyleneurea, propyleneurea, or other cyclic urea, melamine, dicyandiamide, cyanamide, urethane, or lactamide.

When employed together with phosphorus or sulfur-containing flame retardant co-reactants, these nitrogen containing co-reactants synergize the flame retardant action of the phosphorus or sulfur.

Synergistic flame retardant properties are also imparted by using silanols or alkoxysilanes capable of hydrolyzing to silanols as co-reactants capable of acid catalyzed co-reaction with monomer units having methylol reagent character. Especially effective are silanols or silicones having primary alcohol groups, amino or amido groups.

When the co-reactant methylol compound has two types of functional groups differing in their rate of acid-catalyzed reactivity, the process of the invention can be employed as the first step of a delayed cure permanent press process. For example, using N-methylolacrylamide and dimethyloldihydroxyethyleneurea as monomer and co-reactant and employing low enough temperatures to avoid fully reacting the functional groups of the dimethyloldihydroxyethyleneurea, a finish is obtained which permits the fabric to be cut, and pressed, and then subject to a final more vigorous cure, thus affording a permanent press finish.

The process of the present invention can be conducted by applying the reactants in any of the methods known in textile finishing, such as padding, spraying, aerosol spraying, application by a "kiss roll" or printing.

All types of textiles can be treated by means of the process of this invention so as to provide them with durable, finishes. Thus, one may treat textiles derived from natural fibers such as cotton, wool, silk, sisal, jute, hemp and linen and from synthetic fibers including nylon and other polyamides; polyolefins such as polypropylene; polyesters such as polyethylene terephthalate; cellulosics such as rayon, cellulose acetate and triacetate; fiber glass; acrylics and modacrylics, i.e., fibers based on acrylonitrile copolymer; saran fibers, i.e., fibers based on vinylidene chloride copolymers; nytril fibers, i.e., fibers based on vinylidenne dinitrile copolymers; rubber based fibers, spandex fibers, i.e., fibers based on a segmented polyurethane; vinyl fibers, i.e., fibers based on vinyl alcohol copolymers; vinyon fibers, i.e., fibers based on vinyl chloride copolymers; and metallic fibers. Textiles derived from blends of any of the above listed natural and/or synthetic fibers may also be treated by means of the process of this invention.

As used herein, the term "textile" or "textiles" is meant to encompass woven or knitted fabrics as well as nonwoven fabrics which consist of continuous and/or discontinuous fibers bonded so as to form a fabric by mechanical entanglement, thermal interfiber bonding or by the use of adhesive of bonding substances.

It should also be noted, at this point, that in addition to being used to impart durable finishes to textiles, the finishing process of this invention can be used for imparting durable finishes to a variety of substrates such as cellulose in the form of paper, wood, plywood, chipboard, jute, batting and the like; urethane forams, rebonded urethane coatings, elastomers; and the like.

Curing can be effected by any means which initiates both the free-radical and acid-catalyzed reactions. Most commonly, this will be by application of heat, in the range of about 50° to 200° C. Lower temperatures can be used but the problem of excessively long cure times, if a very reactive catalyst is used, the stability of the treating solutions may be inadequate. Higher temperatures can be used but may cause fabric damage. Curing times of from a few seconds at the higher temperatures to a few days at the lower temperatures are used. Those skilled in the art will realize that the required time can be readily determined by routine experimentation in any given equipment, wherein the time will be varied upwards until an adequate cure is found to have occurred as evidenced by wash-durability of the finish. The actual time will be a function of catalyst choice and amount, fabric type, heat-transfer characteristics of the equipment, the presence of dyes and other ingredients on the fabric or in the finish, moisture content of the fabric and other variables well known to the textile finishers.

The conjoint radical-acid catalyzed cure can be also brought about by application of a catalyst activator, such as sulfur dioxide which brings about a "redox" reaction with the peroxide-type free radical initiator and also produces an acidic reaction by virtue of the sulfurous acid and sulfuric acid formed on the fabric.

When heat is the means employed, it may be applied by radiation (as for example by heat lamps), convection, (as in an oven), conduction (as by means of heated rollers) or by impinging steam or other heated gas onto or through the fabric. The free radical portion of the reaction can be assisted by the conjoint use of actinic radiation such as ultraviolet light, corona discharge, electron beam, or gamma radiation.

To further illustrate the invention, the following examples are presented. These examples are for illustrative purposes only and are not to be construed as limiting the scope of the present invention. Unless otherwise stated, all percentages and parts are by weight.

EXAMPLE 1

This example illustrates the preparation of a water repellant and fabric softening finish in situ on cotton:

A formulation is made of the following composition:

N-methylolacrylamide:10%
N-methylolstearamide or stearamide:5%
ammonium persulfate:0.5%
water:33%
isopropyl alcohol:50%
polyoxyethylated alkylphenol surfactant:1.5%.

Cotton cloth is padded to 70% wet uptake and dried at 60° to 70° C. then heated to 150° C. for 5 minutes to effect curing. The resultant fabric exhibits durable water repellant properties and soft hand.

EXAMPLE 2

This example illustrates imparting a permanent press finish to cottom broadcloth with a delayed cure.

An aqueous formulation is made of the following composition:

N-methylolacrylamide:10%
dimethyloldihydroxyethyleneurea (Sun Chemical Co. "Permafresh 183):10%
potassium persulfate:0.3%
zinc nitrate:0.6%.

A cotton broadcloth is padded to 75% wet uptake then heated to 120° C. for 2 minutes to effect drying and some curing but very little cross-linkage (as evidenced by ease of cutting and sewing). The cloth is then cut and sewn to make garments which are pressed at 145° to 150° C. and then the cure completed to effect cross-linking at 165° to 170° C. for 3 minutes. The finished article retains its press and crease resistance during normal use and laundering.

EXAMPLE 3

This example illustrates the preparation of a flame retardant finish in situ on cotton.

Three aqueous finishing solutions are formulated as follows:

| | A | B | C |
|---|---|---|---|
| $(CH_3O)_2P(O)CH_2CH_2CONHCH_2OH$ | 28% | 28% | 28% |
| N-methylolacrylamide | 15% | 15% | 15% |
| potassium persulfate | 0.5% | — | 0.5% |
| ammonium chloride | — | 0.5% | 0.5% |
| non-ionic surfactant | 0.01% | 0.01% | 0.01% |

-continued

| | A | B | C |
|---|---|---|---|
| polyethylene emulsion softener | 1% | 1% | 1% |

Cottton (3.8 oz./yd² flannel) is padded to 101–102%; wet pick up, dried 1.5 minutes at 250° F., cured 1 minute at 350° F. After one water washing, the cloth was found to pass the Federal Vertical Flammability Test DOC FF-3-71 with 3–4 inches char length. After 10 detergent washes, only the cloth treated with formulations A and C passed the test, indicating the necessity for the free radical polymerization catalyst.

Similar results are obtained by substituting methylolated diacetonylacrylamide (Lubrizol Corp. "HMDAA") for N-methylolacrylamide, and ammonium persulfate for potassium persulfate.

EXAMPLE 4

This example further illustrates the preparation of a flame retardant finish on cotton.

An aqueous formulation is prepared as follows:

N-methylolacrylamide:13.8%
tris(hydroxymethyl)phosphine oxide:21%
potassium persulfate:0.5%
ammonium chloride:0.5%
non-ionic wetting agent:0.1%.

Cotton cloth is padded in this solution and dried at 250° F. for 1.5 minutes, then cured at 350° F. for 1 minute. The flammability is evaluated by the limiting oxygen index (LOI) method (ASTM D-2863). Also for application to textiles see Tesoro and Meiser Text Res. J. 40 430-436 (1970). Initial LOI of the treated cloth is 30.78%. LOI of the untreated cloth is 17.8%. After 10 detergent washes, the LOI of the treated cloth is 27.25% indicating that a major part of the flame retardant finish was retained.

A similar experiment using a product derived by acid-catalyzed dehydrative oligomerization of tris(hydroxymethyl) phosphine oxide, in place of tris(hydroxymethyl)phosphine oxide itself, shows an even higher degree of durability, both on cotton and on cotton-polyester blend.

EXAMPLE 5

This example further illustrates the preparation of a flame retardant finish on cotton flannel.

| | A | B |
|---|---|---|
| 3-(dimethylphosphono)propionamide | 30% | — |
| N,N',N''-trimethylphosphoric triamide | — | 30% |
| N-methylolacrylamide | 18% | 18% |
| potassium persulfate | 0.5% | 0.5% |
| non-ionic wetting agent (Rohm & Haas - Triton X100) | 0.1% | 0.1% |

Cotton flannel (3.8 oz/yd²) is padded, dried and cured as in the preceding example. Both cloths exhibit initial LOI values of above 31 and retain a major part of their flame retardancy after vigorous laundering with a commercial phosphate-built detergent.

What is claimed is:

1. A process for producing a washdurable finish on a textile which comprises applying to the textile an effective amount of:

a. at least one free radical polymerizable monomer selected from the group consisting of acrylamide, methacrylamide, N-methylolacrylamide. N-methylolmethacrylamide. N-(alkoxymethyl) acrylamide, diacetone-acrylamide, the methylolated products of diacetoneacrylamide, 2-hydroxyethylacrylate and 2-hydroxyethyl methylacrylate;

b. at least one co-reactant having a reactive, hydroxy, alkoxy or amino group capable of undergoing acid-catalyzed condensation with a reactive group on said free radical polymerizable monomer (a) provided that said co-reactant is not the same as said free radical polymerizable monomer;

c. at least one free radical generating catalyst and at least one acid catalyst, or at least one catalyst having free radical generating and acidic chracteristics, and d. subjecting said textile to curing conditions to conjointly effect free radical polymerization and acid-catalyzed condensation reactions.

2. The process of claim 1 wherein curing is conducted by heating the textile to 50°–200° C.

3. The process of claim 1 wherein the free radical polymerizable monomer is N-methylolacrylamide.

4. The process of claim 1 wherein the co-reactant is selected from $HOCH_2NHCOCH_2CH_2PO(OCH_3)_2$, $NH_2COCH_2CH_2PO(OCH_3)_2$, $(CH_3NH)_3PO$, $(HOCH_2)_3PO$ and oligomeric products from dehydrating $(HOCH_2)_3PO$.

5. The process of claim 1 wherein the catalyst is a water persulfate salt.

6. The process of claim 1 wherein the free radical polymerizable monomer is present in amounts ranging from about 2 to 50% by weight based on the weight of textile.

7. The process as defined in claim 1 wherein the co-reactant is present in amounts ranging from 2 to 50% by weight based on the weight of textile.

8. The process as defined in claim 1 wherein the amount of catalyst employed ranges from about 0.01 to 10% by weight of the reactant.

9. The process as defined in claim 1 wherein a phosphorus or sulfur-containing co-reactant is added to impart a flame retardant finish to the textile in sufficient amount to impart from about 0.5 to 5% phosphorus or sulfur to the fabric.

10. The process as defined in claim 11 wherein sulfur dioxide is employed as the catalyst activator.

11. The process as defined in claim 1 wherein a catalyst activator is employed with a free radical initiator too conjointly effect freee radical polymerization and acid-catalyzed condensation reactions provided that said catalyst activator is not the same as said acid catalyst.

* * * * *